United States Patent [19]

Campbell, Jr.

[11] 4,253,826

[45] Mar. 3, 1981

[54] TRUNCATED TRIANGULAR SKID PIPE

[76] Inventor: Frank Campbell, Jr., 2274 Broadlawn, Houston, Tex. 77058

[21] Appl. No.: 74,195

[22] Filed: Sep. 10, 1979

[51] Int. Cl.[3] ..... F27D 3/02

[52] U.S. Cl. ..... 432/234; 138/137

[58] Field of Search ..... 432/234; 138/147, DIG. 11

[56] References Cited

U.S. PATENT DOCUMENTS

| | | | |
|---|---|---|---|
| 1,753,220 | 4/1930 | Stanbery et al. | 432/234 |
| 3,214,152 | 10/1965 | Molz | 432/235 |
| 3,236,507 | 2/1966 | McKie | 432/234 |
| 3,304,070 | 2/1967 | Jones | 432/234 |
| 3,337,199 | 8/1967 | Kirkpatrick | 432/234 |
| 3,367,641 | 2/1968 | Molz | 432/234 |
| 3,471,134 | 10/1969 | Cone | 432/234 X |
| 3,552,729 | 1/1971 | Hepp et al. | 432/234 |
| 3,642,261 | 2/1972 | Laws | 432/234 |
| 3,706,448 | 12/1972 | Salter et al. | 266/1 R |
| 3,792,386 | 2/1974 | Schuster et al. | 138/DIG. 11 |
| 4,035,141 | 7/1977 | Knaak | 432/234 |
| 4,056,350 | 11/1977 | Knaak | 432/234 |

*Primary Examiner*—John J. Camby

*Attorney, Agent, or Firm*—Fulbright & Jaworski

[57] ABSTRACT

A water-cooled skid pipe suitable for supporting metal shapes such as billets, blooms and slabs in a metallurgical reheat furnace. The skid pipe has a base member, a pair of upwardly extending, converging side members and an apex member connecting the uppermost portions of the side members, all such members defining a passageway therethrough suitable for conducting a fluid. A pair of shoulders extend outwardly of the junction of each side member and the apex member, which shoulders and apex member receive the slag which is deposited by the metal shapes onto the skid pipe and prevent the slag from migrating into the seam between the skid pipe and a surrounding insulator. The shoulders further protect any suitable insulator, which can be applied around the base member and converging side members, from direct contact by the metal shape thereby substantially minimizing the impact of the metal shape upon the insulator. The metal shape can be supported directly by the apex member or by a skid member secured atop the apex member. The invention can be used outside a furnace as an improved structural support member.

14 Claims, 4 Drawing Figures

TRUNCATED TRIANGULAR SKID PIPE

BACKGROUND OF THE INVENTION

In the steel mills and related metallurgical industries, it is customary to form a basic metal shape often called a slab, billet or bloom which is ultimately worked into another form or shape before it leaves the mill. In order to rework the basic shape, it is frequently necessary to reheat the shape in order to make it more malleable during the reworking procedure. A typical metallurgical furnace includes a complex network of vertical and horizontal water-cooled pipes which support an additional network of horizontal circular water-cooled skid pipes which have wear-resistant metal strips along their upper surfaces over which the shapes, in the case of a pusher-type furnace, can be pushed through the furnace during the reheat procedure.

During furnace operations, the movement of the metal shapes along the skid pipes causes large amounts of stress and bending forces to be applied directly to the skid pipe. These forces in combination with the high temperature environment frequently cause the failure or serious degradation of portions of the skid pipe system within the furnace thereby necessitating the shutdown of the furnace for repairs.

The skid pipe, which conventionally includes a circular water-cooled pipe, a refractory around the pipe and some sort of a wear-resistant strip or skid secured to the top of the pipe, must simultaneously provide sufficient support for the metal shapes being pushed across the skid, sufficient resistance to vibrations and coupling effects or moment forces, permit a sufficient flow of cooled water through it to maintain the skid pipe system at a sufficiently low operating temperature, and retain a refractory around the skid rail, excepting the actual skid itself, which reduces heat loss from the furnace into the pipe.

The industry today generally utilizes a skid pipe comprising a circular water-cooled pipe, a metal skid which is welded to or otherwise attached to the top of the circular pipe and a heavy pre-fired ceramic brick refractory which encompasses a majority of the water-cooled pipe. The industry has unsuccessfully attempted to secure the heavy pre-fired ceramic brick around the circular pipe by welding metal studs to the pipe which project outwardly of the pipe into corresponding recesses within the refractory. The procedure for welding the studs to the pipe is tedious and expensive, while at the same time requiring a vast expenditure of labor in order to apply the refractory to the water-cooled skid pipe. High temperature slag tends to collect on the upper portion of the water-cooled pipe as the slag falls or is scraped from the overhead metal shape. Hence, the slag encroaches into the seams between the refractory and the pipe and quickly causes the refractory to fall from the skid rail system. Furthermore, the vibrations caused by the passing of the metal shapes over the skid rails is transmitted along and throughout the skid pipe system which causes the brittle ceramic tiles or pre-fired ceramic brick to fracture and/or to break the metal studs from the pipe, the result in any event being that the water-cooled skid pipe quickly becomes uninsulated and the source of a tremendous energy loss in the furnace.

The use of refractory cements to reinforce and protect the seams or margins between the sections of a refractory or between the refractory and the water-cooled pipe have further proved less than desirable inasmuch as the vibrations cause the brittle cement to fracture and fall from the skid rail in a brief period of time.

Although various shapes of the water-cooled skid pipe have been tested and used, such as, for example, elliptically-shaped, triangular-shaped, teardrop-shaped skid rails and the like, these shapes have been utilized in order to reduce the "shadow effect." The shadow effect is a phenomenon in the metallurgical reheat furnace which results from those portions of the metal shapes which are in contact with the cooler metal skid on the skid pipe which in turn draws a disproportionate amount of heat from the corresponding surface of the metal shape and deposits that heat into the cooling water within. The various shapes of water-cooled pipe which have been utilized in skid pipe systems, however, have in no way resolved the fundamental problem encountered; that is, increasing the ability of the skid pipe to withstand the vibrations, moments and forces exerted upon it during operation and the preventing of slag from migrating into the seams between the skid pipe and insulator thereby causing the the surrounding refractory quickly to be parted from the water-cooled skid pipe thereby permitting unacceptable amount of heat to be transferred into the flowing water and forever lost outside the furnace.

SUMMARY OF THE PRESENT INVENTION

The present invention relates to a structural member which includes a truncated triangular-shaped pipe, the truncated apex of the pipe having a pair of shoulders which extend outwardly of the walls which upwardly converge. Secured to the top of the apex can be a wear-resistant skid, if the structural member is used as a skid rail, which can be of any shape so long as it permits the metal shape to be pushed along the skid through the furnace during the reheat procedure. When used as a skid pipe the cross-sectional area of the interior passageway of the present invention is preferably nearly the same as the cross-sectional area of the interior passageway of the present circular pipes in order that the present invention can quickly be incorporated into the existing waterflow patterns of the existing skid pipe networks. The base member, the converging side members and the apex member of the pipe, including the outwardly extending shoulders, are preferably extruded as one piece. The wear-resistant skid rail secured to the apex member of the pipe may also be extruded with the remainder of the pipe in order to be integral therewith and to reduce warping of the skid pipe which often occurs when a welded skid rail cools.

When used as a skid pipe, the upper edges of a surrounding refractory can intimately abut the shoulders of the water-cooled skid pipe. Hence, the shoulders reduce the deleterious effects on a refractory which result when a portion of the metal shape slides off the skid rail onto the remainder of the skid pipe system. Furthermore, the slag and scale which generally collect around the skid and on top of the apex member of the pipe does not directly bear on the seam between the refractory and the shoulder of the pipe thereby reducing greatly the encroachment of the slag into the seam. Hence, the effective life of the refractory, which is in part measured by its ability to remain on the pipe, is greatly enhanced.

The structural member can also be used outside a high temperature environment to replace other structural support members such as double I beams, I beams and the like.

It is therefore an object of the present invention to provide a water-cooled skid pipe which is more resistant to the moments, forces and vibrations occurring during furnace operations than a conventional circular pipe.

Another object of the present invention is to provide a skid pipe which offers increased protection to a surrounding refractory from direct contact by a metal shape.

Still another object of the present invention is to provide a water-cooled skid pipe which greatly reduces the migration of slag into the seam between a surrounding insulator or refractory and the water-cooled skid pipe.

A further object of the present invention is to provide an improved structural member suitable for use as a load bearing support member such as a double I beam.

These and other objects and advantages of the present invention will become apparent when read in light of the drawings, specification and claims below.

DESCRIPTION OF THE PREFERRED EMBODIMENT

Figure 1:
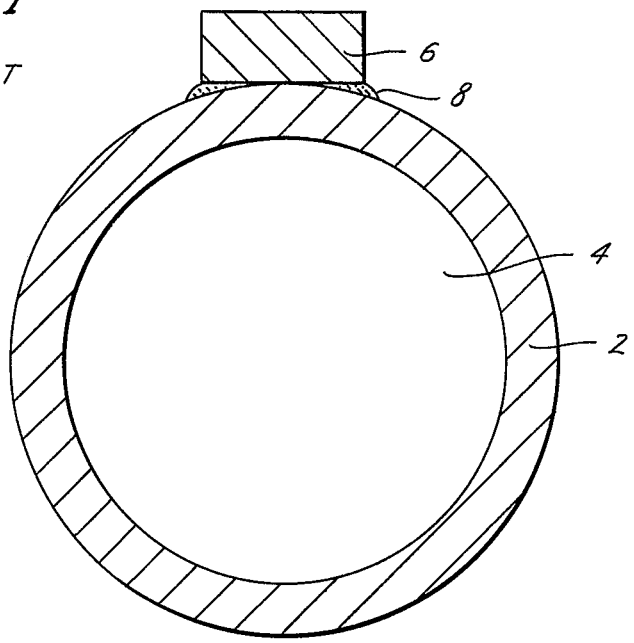
Fig. 1 PRIOR ART
FIG. 1 is an elevational view in cross section of a conventional circular skid pipe with a separate skid rail welded to the uppermost portion thereof.

FIG. 1 shows a conventional skid pipe including a circular pipe 2 having a passageway 4 therethrough, and a metal strip or skid rail 6 which is conventionally secured to the circular pipe 2 by a weld 8. A fluid, conventionally cool water, flows through the passageway 4 in order to maintain the temperature of the skid pipe within operating limits in order to prevent structural failure and scaling of the skid pipe.

Figure 2:
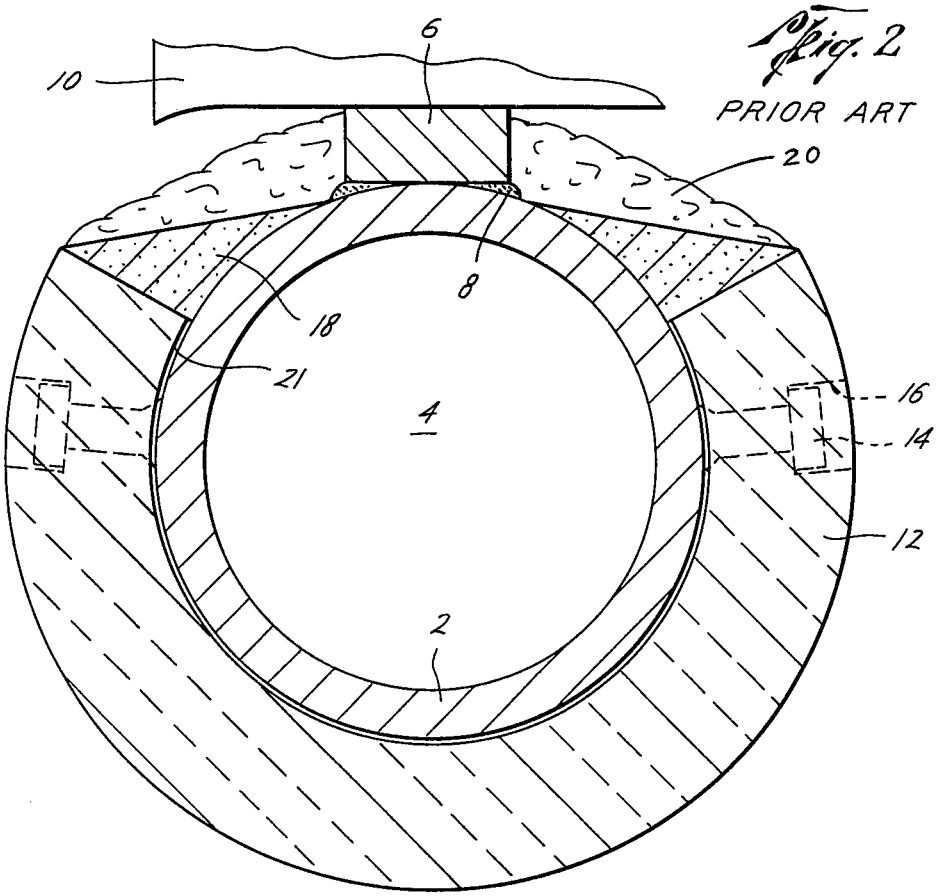
Fig. 2 PRIOR ART
FIG. 2 is an elevational view in cross section of a conventional circular skid pipe, an insulator partially surrounding the pipe, a refractory cement located at each margin of the surrounding refractory, the lower portion of a metal shape resting on top the skid rail and an amount of slag deposited on top one of the refractory cement protectors.

As shown in FIG. 2, the skid pipe, excepting the skid rail 6, is insulated by a suitable refractory 12 in order to reduce the heat transfer from the furnace through the pipe and into the cool water which flows outside the furnace thereby causing an irreparable heat loss. The refractory 12 can be secured to the skid pipe by means of, for example, a metal stud 14 welded to the skid pipe which is received by a recess 16 in the insulator. The studs 14 and recesses 16 are conventionally located on both sides of the skid pipe and insulator combination and at sufficiently frequent intervals along the structure to permit support of the insulator 12 by the skid pipe.

As shown in FIG. 2, a metal shape 10, such as a slab, billet or bloom, is supported by the skid rail 6 as the metal shape 10 is pushed along the skid pipe in a longitudinal direction. An amount of slag 20 is deposited by the metal shape 10 onto the skid pipe and collects as a residue which migrates into the seam 21 located between the skid pipe and the refractory 12. Migration of the slag 20 into the seam 21 hastens the degradation of the refractory 12 thereby causing the refractory to separate and fall from the skid pipe. Hence, in a short period of time, the deleterious effects of the slag 20 can cause the removal of the insulator 12 from the skid pipe which in turn greatly increases the heat loss through the skid pipe, the scaling of the skid pipe and even the structural failure of the skid pipe.

A brittle refractory cement 18 is conventionally applied to the skid pipe and the upper margins of the refractory 12 in order to minimize the migration of the slag 20 into the seam 21. The movement of the metal shape 10 along the skid rail 6 induces vibration and flexion of the skid pipe. The vibration and flexion in turn causes the brittle refractory 18 to crack and fall away from its position on the skid pipe. Furthermore, the metal shape 10 can slide off the skid rail 6 and directly contact the refractory cement 18 thereby causing the refractory cement to separate from the skid pipe and expose the seam 21 to the slag 20. Hence, a skid pipe with greater resistance to flexion and with a means to protect the surrounding insulator 12 from direct contact by the metal shape 10 or from the deleterious effects of the slag 20 is desirable.

Figure 3:
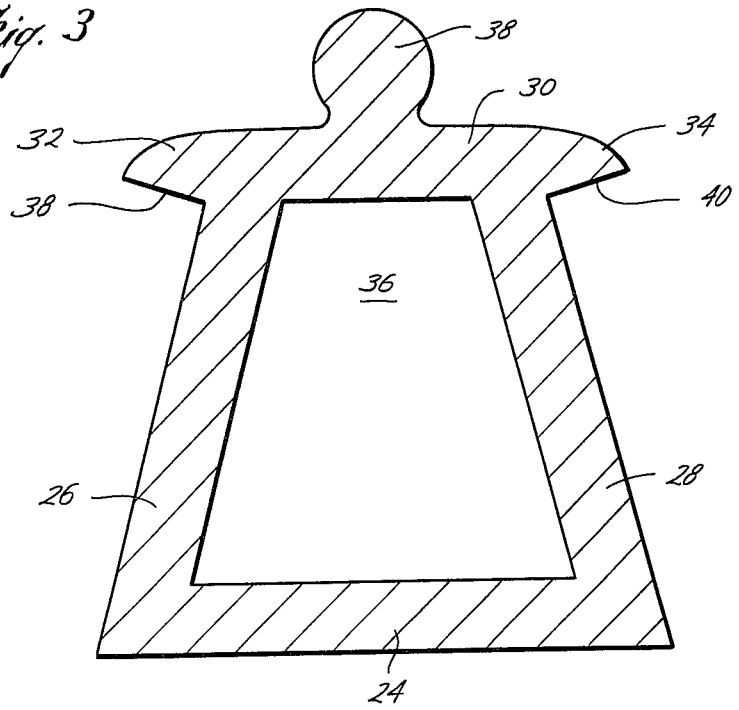
FIG. 3 is an elevational view in cross section of the invention including the outwardly projecting shoulders.
Figure 4:
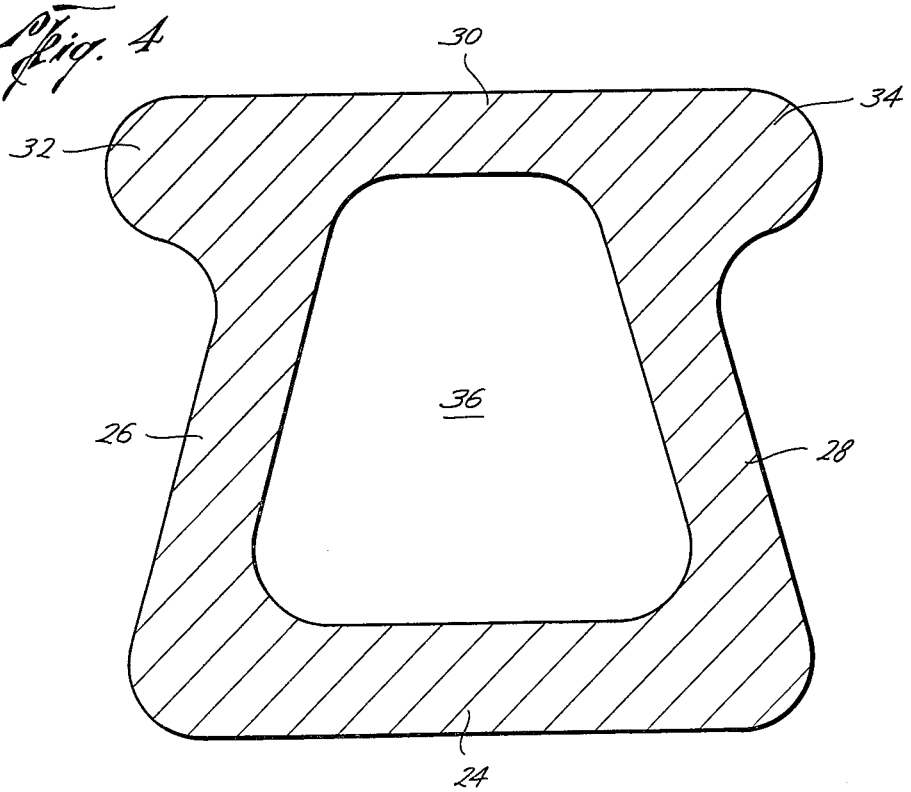
FIG. 4 is an elevational view in cross section of another embodiment of the invention in which the apex member directly supports the metal shape and the shoulders and base member having rounded surfaces.

The present invention is shown in FIGS. 3 and 4. In FIG. 3, a truncated triangular skid pipe is shown having a base member 24. A first side member 26 and a second side member 28 extend upwardly from the base member 24 as shown and converge toward one another. The uppermost portions of the side members 26, 28 are connected to an apex member 30. A passageway 36 is defined by the surrounding base member 24, side members 26, 28 and apex member 30, which passageway is suitable for conducting a fluid therein. Preferably, the cross-sectional area of the passageway 36 is not significantly different from the cross-sectional area of the conventional passageway 4 in order that existing furnaces can be retrofitted with a minimum of modification to the flow control system.

A pair of shoulders 32, 34 project outwardly as shown in FIGS. 3 and 4 from the uppermost portions of the first and second side members respectively. The shoulders 32 and 34 also project outwardly from the adjacent portions of the apex member and, as shown in FIGS. 3 and 4 may appear to be extensions of the apex member 30. A suitable insulator can be applied around the exterior of the base member 24 and the converging side members 26, 28. The refractory preferably will abut the adjacent portions of the shoulders 32, 34.

The shoulders 32, 34 offer significantly more protection to the insulator against a metal shape slipping off the conventional skid rail 38 onto the remainder of the skid pipe. Hence, there is less likelihood that the surrounding insulator will be struck from the skid pipe under such circumstances.

The shoulders 32 and 34 further provide an effective barrier against the deleterious effects of slag accumulation on the skid pipe. The apex member 30 and the shoulders 32 and 34 effectively receive the slag as it is deposited upon the skid pipe. Because the shoulders project outwardly from the side members, the seams 38 and 40 which are located between the shoulders 32 and 34 and a surrounding insulator (not shown) are misaligned from the vertical thereby reducing the tendency of the slag to migrate within the seams. Furthermore, because the need for a brittle refractory cement has been eliminated by the use of the shoulders 32 and 34, the seams 38 and 40 are not exposed later to increased slag migration as the cement falls away.

In FIG. 4, another embodiment of the novel skid pipe is shown. The embodiment of FIG. 4 can be termed a structural member when used outside a high temperature environment and without the necessity of flowing a liquid through the passageway 36. The physical strength advantages of the embodiment of FIG. 4 remain unchanged.

The embodiment in FIG. 4, when used as a skid pipe, discloses that the apex member 30 is the means to contact and support the metal shape. The apex member 30 can be flat, or can be somewhat convex in order to reduce the "shadow effect" upon the supported metal shape. As clearly shown in FIG. 4, the shoulders 32, 34, the first and second ends of the base member 24, and the interior corners of the passageway 36 can be given a radius as opposed to sharply defined corners. Hence, the embodiment as shown in FIG. 4 can easily be extruded as an integral skid pipe, the shoulders 32, 34 being integral with the uppermost portions of the side members 26, 28, respectively and integral with the adjacent portions of the apex member 30, and the side members 26, 28 being integrally secured to the first and second ends respectively of the base member 24. Those skilled in the art will realize that any appropriate skid rail, such as the skid rail 38 as shown in FIG. 3, or any other supporting shape, can be extruded integrally with the embodiment as shown in FIG. 4.

Because of the novel geometry of the present invention, the new skid pipe and structural member as shown in FIGS. 3 and 4 reduces the flexion of the invention as opposed to the conventional circular design known in the prior art. When compared with the standard 4" xx circular pipe, a comparably sized truncated triangular skid pipe and structural member as shown in FIG. 4 has been calculated to achieve the following results:

EXAMPLE

TRIANGULAR SKID RAIL COMPARISON TO 4" xx PIPE

| Property | Truncated Triangular Skid Pipe | Units | 4" xx | Units | N % |
|---|---|---|---|---|---|
| water passage area | 7.500 | $IN^2$ | 7.803 | $IN^2$ | 96.1 |
| face area of metal | 11.656 | $IN^2$ | 8.101 | $IN^2$ | 143.9 |
| weight/ft w/o water | 39.584 | lb/ft | 27.540 | lb/ft | 143.7 |
| weight/ft w/water | 42.823 | lb/ft | 30.920 | lb/ft | 138.5 |
| center of gravity (centroid) | $\bar{x} = 0$ | IN | $\bar{x} = 0$ | IN | $\bar{x} = 0$ |
| | $\bar{y} = 2.330$ | | $\bar{y} = 2.250$ | | $\bar{y} = 103.6$ |
| moment of inertia | 27.361 | $IN^4$ | 15.280 | $IN^4$ | 179.1 |
| section modulus | 11.743 | $IN^3$ | 6.793 | $IN^3$ | 172.9 |
| radius of gyration | 1.532 | IN | 1.374 | IN | 111.50 |
| maximum bending moment | 764,580 | in lbs. | 407,580 | in lbs. | 172.9 |
| crush strength | 704,580 | lbs. | 407,580 | lbs. | 172.9 |

$$\text{Comparison} = \frac{\text{truncated triangular skid pipe}}{4'' \text{ xx}} (100) = N\ \%$$

The calculated maximum bending moment and crush strength of the above noted example were obtained for a twelve-inch length of the embodiment as shown in FIG. 4, for a length uniformly loaded at 60,000 psi ultimate stress.

The test results clearly show that as compared to a conventional 4" xx circular pipe, a comparable truncated triangular skid pipe as shown in FIG. 4 has approximately 172.9% the strength of the conventional design.

It is clear therefore that the invention as shown and described herein fully meets the objects stated above. The unique geometry of the truncated triangular design with outwardly extending shoulders provides a stronger, more stable skid pipe for operations in a metallurgical reheat furnace. The unique design also provides a high strength, efficiently arranged structural support member for use outside a high temperature environment. When used as a skid pipe, the increased strength and stability reduces the flexion of the skid pipe thereby providing a more rigid skid pipe and reducing the degenerative effect of flexion upon the surrounding insulator. Moreover, the unique outwardly extending shoulders greatly reduce the probability of contact by the metal shape directly upon an insulator around the skid pipe. The unique function of the outwardly extending shoulders further minimize the probability of migration of accumulated slag into the seam between the skid pipe and a surrounding insulator. Hence, not only does the present invention provide for a stronger, more stable support for the metal shape, but it further permits a longer, more useful life of the insulator during furnace operations, thus reducing down time and energy loss.

Although a preferred embodiment has been shown and described herein, it is understood that any number of alterations, modifications, reversal of parts and other equivalent structures lie within both the spirit and scope of the claims below.

What is claimed is:

1. A water cooled skid pipe for supporting a metal shape in a high temperature environment comprising:

a. a base member having first and second ends;

b. first and second side members extending upwardly from the first and second ends respectively of the base member, said upwardly extending side members converging toward one another;

c. an apex member connecting the uppermost portions of the converging side members to form a substantially truncated triangular configuration;

d. first and second shoulders projecting outwardly from the uppermost portions of the first and second side members respectively and from the apex member;

e. a passageway through the skid pipe defined by the base member, first and second side members and the apex member, said passageway suitable for communicating a fluid therethrough; and f. means to contact and support the metal shape.

2. The device in claim 1 wherein the first and second side members are each integrally secured to the base member.

3. The device of claim 1 wherein the uppermost portions of the upwardly extending side members are integrally secured to the apex member.

4. The device of claim 1 wherein the first and second shoulders are integrally secured to the apex member and the uppermost portions of the first and second side members respectively.

5. The device of claim 1 wherein the first and second side members are each integrally secured to the base member, the uppermost portions of the side members are integrally secured to the apex member and the first and second shoulders are integrally secured to the apex member and the uppermost portions of the first and second side members respectively.

6. The device of claim 1 wherein the means (e) is the apex member.

7. The device of claim 1 wherein the means (e) is a skid rail connected to and projecting upwardly from the apex member.

8. A structural member comprising:

a. a base member having first and second ends:

b. first and second side members extending upwardly from the first and second ends respectively of the base member, said upwardly extending side members converging toward one another;

c. an apex member connecting the upper most portions of the converging side members to form a substantially truncated triangular configuration, the apex number, base member, first and second side members defining a passageway therein and d. first and second shoulders projecting outwardly from the uppermost portions of the first and second side members respectively and from the apex member.

9. The device of claim 8 wherein the first and the second side members are each integrally secured to the base member.

10. The device of claim 8 wherein the uppermost portions of the upwardly extending side members are integrally secured to the apex member.

11. The device of claim 8 wherein the first and second shoulders are integrally secured to the apex member and the uppermost portions of the first and second side members respectively.

12. The device of claim 8 wherein the first and second side members are each integrally secured to the base member, the uppermost portions of the side members are integrally secured to the apex member and the first and second shoulders are integrally secured to the apex member and the uppermost portions of the first and second side members respectively.

13. A skid pipe for supporting a metal shape in a high temperature environment comprising:

a. a base member having first and second ends;

b. first and second side members extending upwardly from the first and second ends respectively of the base member, said upwardly extending side members converging toward one another;

c. an apex member connecting the uppermost portions of the converging side members to form a substantially truncated triangular configuration;

d. first and second shoulders projecting outwardly from the uppermost portions of the first and second side members respectively and from the apex member; and e. a means to cool the skid pipe.

14. The device in claim 13 wherein the means (e) is a passageway through the skid pipe defined by the base member, first and second side members and the apex member, said passageway suitable for communicating a fluid therethrough.

* * * * *